United States Patent [19]

Saito et al.

[11] 4,263,870

[45] Apr. 28, 1981

[54] COATING PROCESS

[75] Inventors: Hiroki Saito; Toshiro Tahara; Akihiko Nagumo; Toshio Shibata; Kimio Yukawa; Minoru Minoda, all of Minami-ashigara, Japan

[73] Assignee: Fuji Photo Film Co., Ltd., Ashigara, Japan

[21] Appl. No.: 824,133

[22] Filed: Aug. 12, 1977

[30] Foreign Application Priority Data

Aug. 12, 1976 [JP] Japan ..... 51-96676

[51] Int. Cl.[3] ..... B05C 1/08

[52] U.S. Cl. ..... 118/259; 118/258; 118/414; 427/428

[58] Field of Search ..... 427/428, 434 A; 118/414, 259, 258

[56] References Cited

U.S. PATENT DOCUMENTS

| | | | |
|---|---|---|---|
| 1,649,960 | 11/1927 | Kratz | 118/258 X |
| 2,066,780 | 1/1937 | Holt | 118/414 X |
| 2,172,326 | 9/1939 | Wittich | 427/428 X |
| 2,432,074 | 12/1947 | Jennings | 427/428 X |
| 2,464,040 | 3/1949 | Huebner | 118/258 X |
| 2,946,307 | 7/1960 | Warner | 118/119 |
| 3,231,418 | 1/1966 | Muggleton | 427/428 |
| 3,473,955 | 10/1969 | Moriarty | 427/428 |
| 3,526,536 | 9/1970 | Spengos et al. | 427/434 A |
| 3,535,157 | 10/1970 | Steinhoff et al. | 427/428 X |
| 3,941,897 | 3/1976 | Vecchia | 427/428 X |
| 4,046,924 | 9/1977 | Tanguy | 427/428 X |

FOREIGN PATENT DOCUMENTS

| | | | |
|---|---|---|---|
| 980510 | 5/1951 | France | 427/428 |
| 4590 | of 1907 | United Kingdom | 427/428 |

*Primary Examiner*—Shrive P. Beck

*Attorney, Agent, or Firm*—Sughrue, Rothwell, Mion, Zinn and Macpeak

[57] ABSTRACT

A bar coating process for coating a coating liquid on a continuously travelling web which comprises the steps of supplying a coating liquid so as to form a liquid reservoir immediately before a position of contact between a bar and the web, and coating the coating liquids on the web using the bar, wherein the bar is axially positioned perpendicularly to the travelling direction of the web, is supported on a supporting member and is rotated in the same direction as that of the web while coming into contact with the web. The diameter of the bar being 6 to 25 mm.

3 Claims, 6 Drawing Figures

FIG. 1
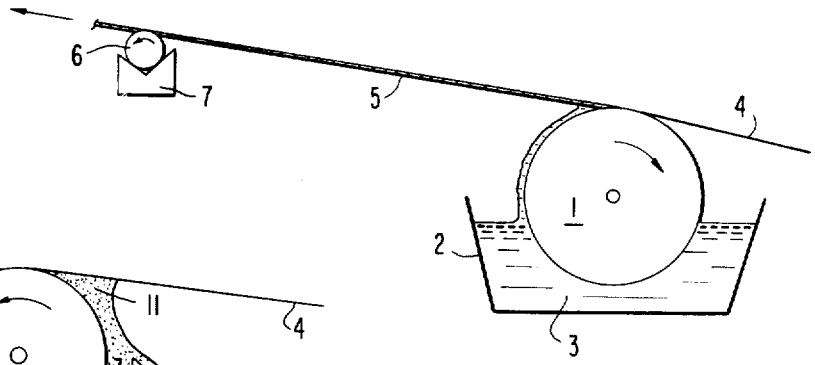
FIG. 2
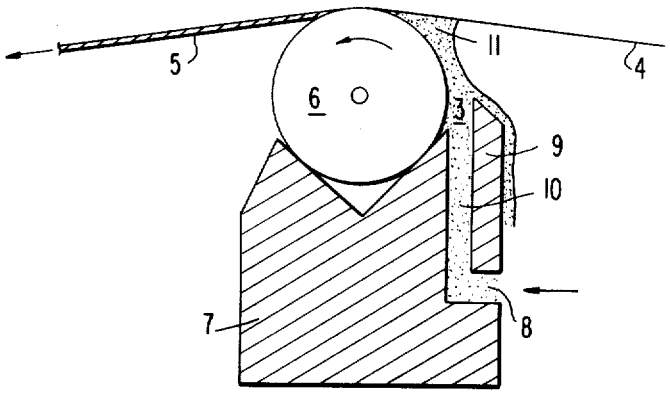
FIG. 3
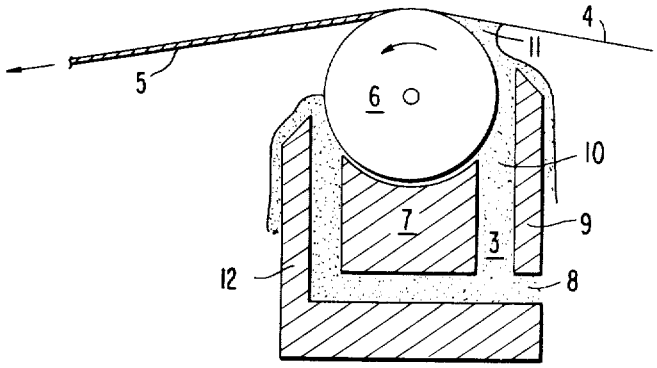
FIG. 4
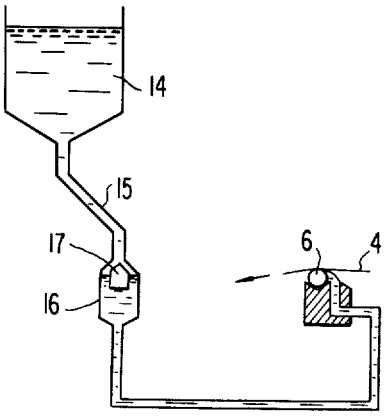
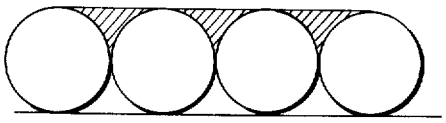
FIG. 5a
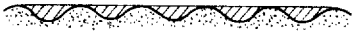
FIG. 5b

COATING PROCESS

BACKGROUND OF THE INVENTION

1. Field of the Invention

The present invention relates to a process for coating coating liquids on a continuously travelling web-like support (hereinafter referred to as a "web"), and more specifically, to an improved bar coating process.

2. Description of the Prior Art

Heretofore, various processes have been proposed to coat coating liquids on a continuously travelling web. Generally, it is considered that coating can be divided into a portion for transferring the coating liquid onto the web (hereinafter referred to as "system of application") and a portion for metering the coating liquid transferred to the web to the desired amount of coating (hereinafter referred to as "system of metering"), so that the coating process has been classified depending on the system of application and the system of metering. Known processes classified by the system of application are processes such as a roller coating process, a dip coating process and a fountain coating process, whereas known processes classified by the system of metering are processes such as an air knife coating process, a blade coating process, and a bar coating process. Further, known processes classified by both the systems of application and metering are processes such as an extrusion coating process, a bead coating process, and a curtain coating process.

Of these coating processes, the bar coating process, wherein excess coating liquid is transferred to the web and thereafter the surplus coating liquid is scraped by a bar which is fixed or rotated in the reverse direction as the direction of travel of the web at a peripheral speed lower than the web to obtain the desired amount of coating, has the characteristic that a thin coating at a high speed by means of a simple device and operation can be accomplished and as a result of this characteristic, the process has widely been used. While a suitable method may be used for the system of application in the bar coating process, the roller coating process, particularly, the kiss coating process, is the most commonly used method in an effort to make good use of the simplicity of the method. FIG. 1 schematically illustrates the bar coating apparatus, in which the kiss coating process is used as the system of application. Referring to FIG. 1, upon rotation of a roll 1, roll 1 picks up a coating liquid 3 in a liquid pan 2 and causes the coating liquid 3 to be transferred and coated on a continuously travelling web 4 to form a film 5, after which a bar 6, axially perpendicular to the direction of travel of the web, is brought into contact with the film 5 before the film 5 dries and solidifies to scrape off surplus of coating liquid 3, thereby metering to the desired amount of coating. Here, the bar 6 is formed by closely winding a wire having a given diameter around the surface of a rod (hereinafter referred to as a "wire bar") or having the surface of the rod formed with grooves of a given width and depth at a given separation, hereinafter pitch (hereinafter referred to as a "grooved bar"). Normally, the bar 6 is fixed, or intermittently rotated, or rotated in the counter direction to that of the web 4 at a peripheral speed lower than the web. The amount of coating may easily and accurately be controlled by suitably selecting the wire diameter of the wire bar, and the width, depth and pitch of the grooves of the grooved bar, and the like.

However, in the prior art bar coating process if a defect in the film surface is produced at the time of application such still remains as a defect even after metering by means of the bar 6. In case of the kiss coating process which is the most common system of application, coating stripes resulting from an uneveness in the thickness of a liquid film on the surface of the roll 1 considered to be caused by the flowing condition of the coating liquids within the liquid pan 2 often occur, and such a defect can not be eliminated sufficiently even by metering by means of the bar 6. In order to prevent the occurrence of such surface defects, proposals have been considered to additionally provide a metering and smoothing metal roll adjacent the roll 1 or to use a more precise application method. However, these approaches themselves result in a decrease of the most important advantage of the bar coating process, which is simplicity, and thus are undesirable.

In addition, in the prior art bar coating process, the system of application is completely independent of the system of metering, and therefore, in the process of coating, it is necessary to individually set the conditions, resulting in drawbacks, which are not only troublesome but require a large space making it uneconomical in space utilization.

SUMMARY OF THE INVENTION

An object of the present invention is to overcome these drawbacks as noted above with respect to the prior art bar coating process by providing an improved bar coating process which can be used to form a film whose surface properties are excellent.

Another object of this invention is to provide a bar coating process which is simple in operation and does not require a large space.

These objects are achieved by the process of this invention which comprises the steps of supplying a coating liquid so as to form a liquid reservoir immediately before the position of contact between a bar and a travelling web, the bar being axially positioned perpendicularly to the direction of travel of the web, supported on a supporting member and rotated in the same direction as that of the travel of the web while coming into contact with the web, and coating the coating liquid on the web using the bar.

BRIEF DESCRIPTION OF THE DRAWINGS

The present invention will now be described in detail by way of preferred embodiments thereof in conjunction with the accompanying drawings, in which FIG. 1 is a schematic illustration of a prior art bar coating apparatus, FIGS. 2 and 3 are schematic illustrations of a bar coating apparatus showing a preferred embodiment in accordance with the present invention, FIG. 4 is a schematic illustration of a liquid level adjusting device in a preferred embodiment of the present invention, and FIGS. 5(*a*) and 5(*b*) are schematic sectional views of a wire bar and a grooved bar, respectively.

DESCRIPTION OF THE PREFERRED EMBODIMENTS

Referring now to FIG. 2, which illustrates schematically a bar coating apparatus in accordance with the present invention, a wire bar or a grooved bar 6, axially perpendicular to the direction of travel of the web, is rotated in the same direction as that of a continuously travelling web 4. A bar supporting member 7 is extended over the full length of the bar 6 to prevent the bar 6 from deflecting and to serve as a liquid supply means for supplying coating liquid 3 to the bar 6. That is, the coating liquid 3 is supplied from a liquid supply port 8 provided in the bar supporting member 7 into a groove 10 for guiding the liquid formed between the bar supporting member and a weir member 9 and are picked up by the rotating bar to be coated onto the web 4. In this case, the coating liquid 3 is metered at a contact portion between the web 4 and the bar 6 and only the desired amount of coating liquid is coated on the web 4, whereas the remaining liquid flows down to form a liquid reservoir 11 together with coating liquid 3 newly supplied. In a steady state, therefore, the coating liquid 3 is coated on the web 4 through the liquid reservoir 11. It has surprisingly been found that when the coating liquid 3 is coated on the web 4 through the liquid reservoir 11, the surface properties of the film are enhanced as compared to those obtained in the prior art. Moreover, the bar 6 has both the functions of transferring and coating the coating liquid on the web and metering the liquid to the desired amount so that the entire apparatus is not only compact effectively utilizing space but various processing conditions may easily be set and the operation becomes easy.

In order to form the liquid reservoir 11 and to maintain this in a steady state, the amount $Q_1$ of coating liquid picked up by the bar 6 must be equal to or greater than the amount $Q_2$ of coating liquid to be coated on the web 4. Generally, if $Q_1$ is greater than $Q_2$, the input of the coating liquid 3 to the liquid reservoir 11 is greater than output thereof, and for this reason, where the volume of the liquid reservoir 11 is maintained constant, the extra coating liquid flows outside the liquid reservoir 11. That is, the extra coating liquid 3 scraped by the bar 6 partly overflows from the weir member 9 and flows down along the external surface of the weir member 9. Thus the coating liquid 3 which overflows and flows down is recovered for reuse as the coating liquid 3.

In order to obtain a coating layer having excellent surface properties by forming such a liquid reservoir 11, the volume of the liquid reservoir 11 must be maintained in a predetermined range. However, since the volume of the liquid reservoir 11 will vary depending upon various conditions, it should actually be determined experimentally.

It will naturally be understood that the present invention is not limited to those embodiments as described above and various changes may be made therein.

For example, the coating liquid 3 can be supplied towards the side of the bar 6 in the above-described embodiment, but it is not always limited to such a supply method and a liquid supply port may be provided directly under the bar 6.

When the bar 6 is rotated at an excessively high speed, bubbles are generated between the bar 6 and the bar supporting member 7 depending upon the kind of coating liquid 3, and as a consequence, the bubbles adhere to the surface of the bar 6, the bubbles are transferred to the film surface, or the bubbles remain in the neighborhood of a contact portion between the bar 6 and the downstream of the web 4 to produce stripes. Since the bubbles are considered to be generated as a result of entrapment of air present between the bar 6 and the bar supporting member 7 by rotation of the bar 6, in order to avoid this the design as shown in FIG. 3 may be employed in which the coating liquid 3 is supplied towards the bar 6 even downstream of the web to overflow the coating liquids from the weir member 12, thus forming a bubble preventing liquid reservoir 13 to prevent air from being entrapped upstream.

Accomplishment of coating without circulating the coating liquid 3, that is, accomplishment of the operation in the form of $Q_1 = Q_2$ may also be achieved readily by maintaining the liquid level of the coating liquid 3 constant using known techniques. FIG. 4 shows one such procedure, in which a float chamber 16 is disposed in a pipe 15 from a coating liquid stock tank 14 to the liquid supply port 8, the float chamber having a float 17 therein, whereby when the liquid level exceeds a given level, supply of the coating liquids 3 from the stock tank 14 is discontinued, whereas when the level drops below the given level, supply of the coating liquid 3 to the float chamber 16 is re-started.

In the present invention, the types of coating liquids used are not particularly limited but water, high polymer aqueous or organic solutions, liquid dispersions of a pigment in water, colloidal solutions and the like may be used. Specific examples of coating liquids to which this invention is applicable include water or organic solvent solutions of gelatin, an aqueous solution of polyvinyl alcohol, an aqueous solution of carboxymethyl cellulose, an aqueous solution of a copolymer of maleic anhydride and vinyl acetate, an aqueous solution of a maleic anhydride copolymer, an aqueous solution of an acrylic acid copolymer, an organic solvent of a cellulose ester, an organic solvent solution of polyvinyl acetal, an organic solvent solution of polyvinyl chloride or polyvinylidene chloride, an organic solvent solution of polystyrene, an organic solvent solution of a phenol resin, an organic solvent solution of an acrylic resin, etc.

Further, a polyvinylidene chloride dispersion in water, a styrene-butadiene dispersion in water, a methyl or ethyl acrylate copolymer dispersion in water, etc. can be coated using the method of this invention.

Organic solvents which can be used in the coating liquid include, e.g., methanol, ethanol, propanol, butanol, acetone, methyl ethyl ketone, ethylene chloride, methylene chloride, tetrachloroethane, ethyl acetate, butyl acetate, methyl Cellosolve, ethyl Cellosolve, dioxane, phenol, cresol, etc.

Suitable pigments which can be coated as dispersions using this invention include kaolin, pyrophyllite clay, calcium carbonate, aluminum hydroxide, titanium oxide, etc.

As described above, the physical properties of the coating liquid which can be coated using this invention are not especially limited, but preferably a lower viscosity is employed, ordinarily, about 100 cp or less, preferably 50 cp or less, more preferably 10 cp or less. There is no particular minimum viscosity which can be coated, but ordinarily a viscosity of about 0.1 cp or higher is employed. Further, the surface tension of the coating liquid is not particularly limited and a suitable contact angle for the coating liquid is about 90° or less (e.g., about 0° to about 90°), preferably 70° or less, more preferably 50° or less. Of course, no problems arise with the contact angle of the coating liquid when an absorbable material such as paper is coated with the coating liquid.

Suitable webs which can be used in the present invention include paper, synthetic resin films, synthetic resin coated paper, synthetic paper, aluminum plates and the like. Synthetic resin films which can be used include, for example, those of a polyolefin such as polyethylene, polypropylene or the like, a vinyl polymer such as polyvinyl acetate, polyvinyl chloride, polystyrene or the like, a polyamide such as 6,6-nylon, 6-nylon or the like, a polyester such as polyethylene terephthalate, polyethylene-2,6-naphthalate or the like, a cellulose ester such as cellulose acetate, cellulose triacetate, cellulose diacetate, and a polycarbonate. Typical synthetic resins which can be used for synthetic resin coated paper are a polyolefin such as polyethylene or the like, but other materials may also be used.

The thickness of web is not particularly limited either, but a thickness from about 0.01 to about 1 mm can be advantageously used in terms of handling and general use.

The bar used in the present invention can be a wire bar or a grooved bar.

In case of a wire bar used in the present invention, a suitable diameter of the bar can be from about 6 mm to about 25 mm, preferably, from 6 mm to 15 mm. The use of bars having a diameter greater than those as noted above is not desirable because longitudinal stripes tend to be produced in the film. Also, the use of bars having a diameter smaller than those as noted above results in a difficulty in manufacture thereof. A suitable diameter of the wire can be from about 0.07 to about 1 mm, preferably, from 0.07 to 0.4 mm. The use of a wire diameter greater than those as noted above is not suitable because the amount of coating increases excessively, and thin layer coating which is the advantage of the bar coater is not achieved, and on the other hand, the use of a wire diameter smaller than those as noted above results in a difficulty in winding a wire to make a wire bar and in a problem in terms of strength. Suitable materials for the wire includes metals, but stainless steel is most suitable from the standpoint of corrosion resistance, wear resistance, strength and the like. In order to further increase the wear resistance of the wire, the surface of the wire may also be plated. Preferably, a hard chrome plating is used.

When a grooved bar is used in the present invention, the pitch of the groove can be from about 0.1 to about 0.5 mm, preferably, from 0.2 to 0.3 mm, and in terms of the cross-sectional configuration thereof, one similar to that of a sine curve is particularly suitable. However, the cross-sectional configuration is not limited to that as noted above, and other cross-sectional configurations may also be employed. Generally, the grooved bar and the wire bar result in the same amount of coating under the same coating conditions when they are equal to each other in hatched area [e.g., as shown in FIGS. 5(*a*) and 5(*b*)] per unit length. Accordingly, a suitable grooved bar may be selected from a view in the wire bar on the basis of the relationship therebetween as described above.

Suitable materials for the bar include metals and, in terms of corrosion resistance and strength, preferably, stainless steel is employed.

Further, suitable materials for the grooved bar include metals and particularly, stainless steel is suitable in terms of corrosion resistance, strength and wear resistance.

As for the bar supporting member, a material of which the frictional resistance between the bar supporting member and the bar (the wire in case of the wire bar) is small must be selected since the bar is rotated at a high speed. Suitable materials for the bar supporting member which are preferably used in the present invention include, for example, resins such as fluorocarbon resins, polyacetal resin, polyethylene resin, polystyrene resin and the like. Of these, polytetrafluoroethylene commercially available under the tradename of TEFLON (a trademark of Du Pont, U.S.A.) and polyacetal resin commercially available under the tradename of DELRIN (a trademark of Du Pont, U.S.A.) are most suitable in terms of the coefficient of friction and strength. Further, polyethylene resins commercially available under the tradename New Lite (a tradename of Sakushin Kogyo K.K., Japan, mol wt.: about 1,500,000 to about 4,000,000; crystal melting point: 135°-138° C., Vicat softening point VSP/B (DIN 53460): 74° C., specific gravity: 0.94, coefficient of friction: 0.11-0.07) and CADCO 1900 (tradename of Cadillac Plastic & Chemical Company, mol wt.: about 2,000,000 to about 5,000,000, specific gravity: about 0.940 to about 0.942) can be suitably used. Further, those materials, in which a filler such as glass fibers, graphite, molybdenum disulfide or the like is added to the above described synthetic resin materials, may be used. Alternatively, after the bar supporting member has been made of a metal, the synthetic resin material as described above may be coated or adhered on the surface thereof to decrease the coefficient of friction between the bar supporting member and the bar. Alternatively, use of various metals impregnated with such synthetic resins, for example, aluminum impregnated with polytetrafluoroethylene, may also be made to manufacture the bar supporting member.

In the present invention, the volume or size of the liquid reservoir which is suitable varies with various conditions, and varies with the properties such as the viscosity of the coating liquid, the construction of the bar and the rotational speed thereof, and the travelling speed of the web. Hence, the volume of the liquid reservoir cannot be set forth unequivocally and must be determined experimentally.

Ultimately, these conditions should be determined experimentally since a plurality of parameters are complicatedly interrelated. However, generally stated, it has been found that there is a limit in the ratio of the rotational peripheral speed $V_b$ of the bar to the travelling speed $V_w$ of the web, and the minimal value of $V_b/V_w$, from which an advantageous result is obtained, becomes small as the viscosity of the coating liquids increases, as the diameter of the wire (in case of the grooved bar, the depth or the width of the groove corresponding thereto) decreases, and the coating speed, i.e., the travelling speed of $V_w$ of the web increases. Specifically, if the wire diameter is set at about 0.1 to about 0.4 mm with the viscosity of coating liquid at about 1 cp to about 25 cp, the minimal value of $V_b/V_w$ may suitably be selected within a range from about 2.0 to about 41% with the travelling speed of the web $V_w$ in the range from about 20 to about 80 m/min. If the $V_b/V_w$ is greater than the minimal value thus determined, the value is not particularly limited. However, when the $V_b$ is excessively high, the bar tends to be worn and to be an easy entry of air, and it is desirable to have the $V_b$ value as small as possible. In case of coating materials such as photographic light-sensitive materials in which scratches are particularly disadvantageous, it is desirable to set the conditions such that no relative speed between the bar and the web exists, that is, the condition in which $V_b/V_w$ is substantially 1.

The present invention provides new effects, which can be used to readily form a film whose surface properties are excellent, and which reduces the amount of space required and is easy to operate since the coating portion and metering portion are integrally formed.

To further clarify the effects in accordance with the present invention, the following examples are given.

EXAMPLE 1

Coating liquids having the compositions and properties as given in Table 1 below were applied to the surface of a polyethylene terephthalate film having a thickness of 180 μ and a width of 380 mm using the wire bar coating apparatus shown in FIG. 2 and varying the coating speeds in order of 20, 40, 60, 80 and 100 m/min. in a coating amount of 8 cc/m$^2$.

TABLE 1

| | |
|---|---|
| Gelatin | 10 weight parts |
| Water | 1000 weight parts |
| Saponin | 1 weight part |
| Viscosity | 2 cp |
| Surface Tension | 38 dyne/cm |

The material used for the wire bar and wire was stainless steel, the diameters of which were 12.7 mm and 0.1 mm, respectively, and the bar was rotated at the same peripheral speed as the travelling web. The material used for the bar supporting member was polytetratfluoroethylene.

Inspection of the thus obtained film surface demonstrated that the quality of surface was good in all cases.

EXAMPLE 2

Coating liquids having the compositions and properties as given in Table 2 below were applied to the surface of a polyethylene terephthalate film having a thickness of 100 μ and a width of 1000 mm using the wire bar coating apparatus shown in FIG. 3 and varying the coating speeds in order of 20, 40, 60, 80 and 100 m/min. in a coating amount of 12 cc/m$^2$.

TABLE 2

| | |
|---|---|
| Copolymer of Dimethylterephthalate, Ethylene Glycol, and Triethylene Glycol (molar ratio: 2 : 3 : 2) | 0.7 weight part |
| Nitrocellulose | 1 weight part |
| Ethylene Chloride | 150 weight parts |
| Viscosity | 1.2 cp |
| Surface Tension | 35 dyne/cm |

The material used for the wire bar and the wire was stainless steel, the diameters of which were 6 mm and 0.15 mm, respectively, and the bar was rotated at the peripheral speeds which were 20%, 50% and 100% of the travelling web. The material used for the bar supporting member was polytetrafluoroethylene.

Inspection of the thus coated film surface proved that the quality of surface was good.

EXAMPLE 3

Coating liquids having the compositions and properties as given in Table 3 below were applied to the surface of a polyethylene-coated paper having a thickness of 240 82 and a width of 300 mm using the wire bar coating apparatus shown in FIG. 3 and varying the coating speeds in order of 10, 20, 30, 40 and 50 m/min. in a coating amount of 32 cc/m$^2$.

TABLE 3

| | |
|---|---|
| Gelatin | 50 weight parts |
| Water | 1000 weight parts |
| Saponin | 1 weight part |
| Viscosity | 30 cp |
| Surface Tension | 38 dyne/cm |

The material used for the wire bar and wire was stainless steel, the diameters of which were 12.7 mm and 0.4 mm, respectively, and the bar was rotated at the same peripheral speed as the travelling web. The material used for the bar supporting member was polytetrafluoroethylene.

It was found from an inspection of the thus obtained film surface that in case of a coating speed of 10 to 30 m/min., the quality of the surface was good, while in case of speeds greater than 40 m/min., a longitudinal stripe-like uneveness occurred, which remained even after drying.

While the invention has been described in detail and with reference to specific embodiments thereof, it will be apparent to one skilled in the art that various changes and modifications can be made therein without departing from the spirit and scope thereof.

What is claimed is:

1. In a coating apparatus for coating a coating liquid on a continuously travelling web including a supply of coating liquid and a rotatable coating bar positioned between said traveling web and said supply of coating liquid and axially perpendicularly to the travelling direction of said web, the improvement comprising said bar being a wire or a grooved bar 6 to 25 mm in diameter, positioned on a support member under said web and rotatable in the direction of said web, said bar picking up said coating liquid from said supply and carrying said coating liquid directly to the lower surface of said web to form a reservoir of said coating liquid in and immediately prior to the nip between said bar and said travelling web and maintaining said reservoir by rotating said bar at a high enough rotating speed to pick up a sufficient amount of said coating liquid.

2. The apparatus of claim 1, wherein said bar sits in a support member and said supply is formed between said support and a weir member positioned approximately perpendicular to the surface of said web.

3. The apparatus of claim 1, wherein the rotating speed of said bar is substantially equal to the speed of said web to prevent scratches on said web.

* * * * *